United States Patent [19]

Carty

[11] Patent Number: 4,681,025

[45] Date of Patent: Jul. 21, 1987

[54] CHIMNEY STACK HAVING ERODABLE LINER WITH ELECTRICAL GENERATING CAPACITY

[76] Inventor: John J. Carty, 2 Model Ct., Rocky Point, N.Y. 11778

[21] Appl. No.: 854,505

[22] Filed: Apr. 22, 1986

[51] Int. Cl.[4] ..... F23J 13/02

[52] U.S. Cl. ..... 98/58; 52/173 R; 110/184; 110/162

[58] Field of Search ..... 52/1, 173 R; 98/58, 98/60; 110/184, 344, 343, 147, 162

[56] References Cited

U.S. PATENT DOCUMENTS

| | | | |
|---|---|---|---|
| 2,282,256 | 5/1942 | Smelik | 98/58 |
| 4,265,166 | 5/1981 | Parker et al. | 98/58 |

FOREIGN PATENT DOCUMENTS

| | | | |
|---|---|---|---|
| 59-9422 | 1/1984 | Japan | 98/58 |
| 2099972 | 12/1982 | United Kingdom | 98/58 |

*Primary Examiner*—Harold Joyce

[57] ABSTRACT

An improved design associated with the fabrication and construction of a chimney stack wherein the liner material utilized as the inner liner of the stack which comes into direct contact with the flue gases being conveyed by the chimney stack to the outside atmosphere comprises erodable material having embedded therein a resistance type electrical or thermal conductivity type alarm system capable of detecting the degree of erosion of the erodable liner of the chimney stack thereby providing the ability to monitor when reconditioning of the inner liner of a chimney stack is required. Additionally, there is also incorporated the utilization of turbine blades positioned within the stream of gas flow within the chimney stack such that the flue gases cause the turbine blades to rotate, said rotation then being converted into the generation of electrical energy for utilization outside of or in accordance with the operation of the chimney stack. Furthermore, by selectively controlling the rotation of the turbine blades and their position within the stream of gas flow within the chimney stack, there is achieved the ability to selectively generate turbulence down stream from the turbine blades' location thereby providing for the ability to selectively reduce the build up of corrosive particles on the erodable liner of the chimney stack thereby increasing the usable life of the inner liner.

5 Claims, 6 Drawing Figures

CHIMNEY STACK HAVING ERODABLE LINER WITH ELECTRICAL GENERATING CAPACITY

BACKGROUND AND OBJECTS OF THE INVENTION

The present invention relates to a new and improved design associated with the fabrication and construction of a chimney stack capable of conveying hot gases generated in conjunction with industrial application to a height within the atmosphere sufficient to meet current pollution standards.

In conjunction with the above, and prior to the present invention, industrial chimney stacks were known but not of a design nor method of construction which lended themselves to the advantages and overall efficiencies achievable in conjunction with the present invention.

More particularly, by utilization of the invention herein disclosed, there is the ability to construct a chimney stack which provides for the monitoring of the degree of erosion occurring with regard to the inner surface of the chimney stack, said surface being that which comes in direct contact with the hot gases passing through the chimney stack, and by having embedded within the material comprising the inner surface of the chimney stack electrical wires arranged a part of an electrical circuit whose electrical conductivity is continually monitored, there is achieved the ability to detect the corrosion and/or erosion of the inner liner of the chimney stack as a result of coming into contact with the flue gases passing through the chimney stack thereby providing a detection system capable of indicating when repairs are needed to be made to the inner surface of said chimney stack prior to the incurring of serious structural damage to the structure.

Additionally, by the utilization of turbine blades positioned within the stream of gas flow within the chimney stack, the flue gases cause the turbine blades to rotate, said rotation then being converted into the generation of electrical energy for utilization outside of or in accordance with the operation of the chimney stack.

Furthermore, by selectively positioning the location of said turbine blades, there is additionally achieved the ability to selectively cause turbulence downstream from the location of said turbine blades within the chimney stack, thus providing a means to selectively reduce the build up of particulate material upon the erodable liner of the chimney stack thereby extending its usable life.

It is in the context of the above that one of the primary objectives of the present invention is to create a new and improved design associated with the fabrication and construction of a chimney stack capable of conveying hot gases generated in conjunction with industrial applications to a height within the atmosphere sufficient to meet current pollution standards that does not exist within the prior art.

It is another object of this invention to create a new and improved design associated with the fabrication and construction of a chimney stack whose design provides for the utilization of an erodable inner liner that has embedded therein electrical wiring arranged as part of an electrical circuit whose conductivity is monitored so as to detect the erosion of said erodable inner liner.

It is another object of this invention to create a new and improved design associated with the fabrication and construction of a chimney stack wherein there is additionally incorporated the utilization of turbine blades positioned within the chimney stack such that the flue gases rising through the chimney stack cause the turbine blades to rotate, said rotation then being converted into the generation of electrical energy for utilization outside of or in accordance with the operation of the chimney stack.

It is another object of this invention to create and new and improved design associated with the fabrication and construction of a chimney stack wherein the rotation of the turbine blades positioned within the stream of gas flow within the chimney stack is selectively regulated so as to control the degree of turbulence within the chimney stack downstream from the location of said turbine blades thereby providing for the ability to reduce particulate build up upon the erodable inner liner of the chimney stack and thus reduce the degree of erosion of said erodable inner liner.

It is another object of this invention to create a new and improved design associated within the fabrication and construction of a chimney stack wherein more than one set of turbine blades is utilized in accordance with the generation of electrical power.

It is another object of this invention to create a new and improved design associated with the fabrication and construction of a chimney stack wherein the turbine blades positioned within the gas flow of the chimney stack are capable of independent rotation caused by the utilization of an electrical motor or other sources of mechanical power capable of rotating the turbine blades, same being utilized so as to selectively determine the degree of air turbulence independent of the kinetic energy characteristics of the flow of gas through the chimney stack that will occur within the chimney stack downstream from the positioning of the turbine blades.

It is another object of this invention to create a new and improved design associated with the fabrication and construction of a chimney stack whose design provides for an economical means for detecting erosion of the inner surface of a chimney stack without the need to shut down the operation of said chimney stack that would be required for manual inspection.

The objects and advantages of the invention are set forth in part herein and in part will be obvious from or may be learned by the practice of the invention, the same being realized and attained by means of the instrumentalities and combinations pointed out in the appended claims.

The invention consists in the novel parts, constructions, arrangements, combinations and improvements herein shown and described.

SUMMARY OF THE INVENTION

Briefly described, the present invention is directed to a new and improved design associated with the fabrication and construction of a chimney stack wherein the liner material utilized as the inner liner of the stack which comes into direct contact with the flue gases being conveyed by the chimney stack to the outside atmosphere comprises erodable material having embedded therein a resistance type electrical or thermal conductivity type alarm system capable of detecting the degree of erosion of the erodable liner of the chimney stack thereby providing the ability to monitor when reconditioning of the inner liner of a chimney stack is required.

The above is achieved by having embedded within the erodable liner material electrically conductive wire arranged as part of an electrical circuit whose electrical conductivity is monitored so as to detect any variations therein, said variations being attributable to the erosion of the erodable liner itself. Thus, there is achieved a self-monitoring detection system capable of indicating erosion of the inner surface of a chimney stack without the need to shut down the operation of said stack.

Additionally, there is also incorporated within the fabrication and construction of said chimney stack, the utilization of turbine blades positioned within the stream of gas flow that occurs within the chimney stack such that the flue gases cause the turbine blades to rotate, said rotation then being converted into the generation of electrical energy for utliization outside or in accordance with the operation of the chimney stack. By selectively controlling the rotation of the turbine blades and the position of the turbine blades within the stream of gas flow within the chimney stack, there is additionally achieved the ability to selectively generate turbulence within the stream of gas flow occurring within the chimney stack downstream from the turbine blades' location thereby providing for the ability to selectively prevent the build up of corrosive particles on the surface of the erodable inner liner of the chimney stack, thus increasing the life of said erodable inner liner.

It will be understood that the foregoing general description and the following detailed description as well are exemplary and explanatory of the invention, but not restrictive thereof.

The accompanying drawings referred to herein and constituting a part hereof are illustrative of the invention but not restrictive thereof, and, together with the description, serve to explain the principles of the invention.

DESCRIPTION OF A PREFERRED EMBODIMENT

Figure 1:
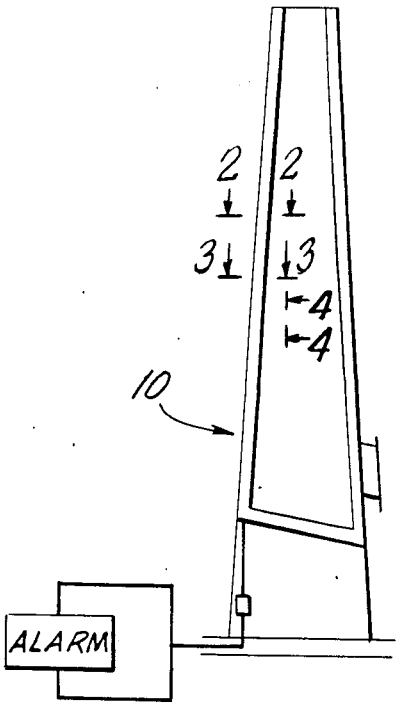
FIG. 1 is a front elevational view of a chimney stack constructed in accordance with the invention.

Referring now more particularly to the embodiment of the above invention illustrated in the accompanying drawings, there is illustrated in FIG. 1, a chimney stack fabricated and constructed in accordance wtih the instant invention and indicated generally by reference number 10.

Figure 2:
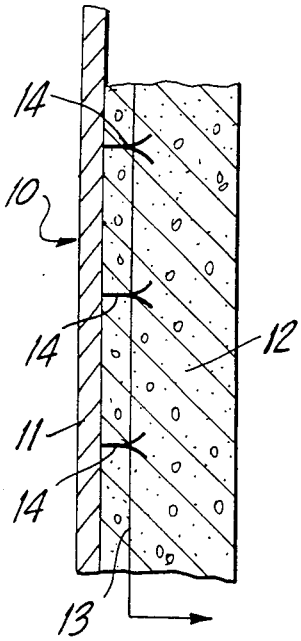
FIG. 2 is an enlarged partial vertical section of the chimney stack illustrated in FIG. 1 and taken along lines 2—2 illustrating the composition of the chimney stack structure at that location constructed in accordance with the invention.

In accordance with the invention and as illustrated in FIG. 2, the wall structure of chimney stack 10 comprises an outer structural support member 11 whose design and composition are well known in the prior art, outer structural support member 11 capable of being fabricated from any number of well known materials utilized in the prior art for such purposes, such as steel, concrete, and the like, it being specifically understood that the scope of this invention is not limited to the specifically recited materials herein referred to from which structural support member 11 is capable of being fabricated, but rather, the scope of the invention extends to any such materials commonly known and usable within the prior art for such purposes. As illustrated in FIG. 2, there is depicted the utilization of steel for outer structural support member 11. Additionally, and in keeping with the invention, inner liner 12 can be fabricated from any one of a number of materials such as shotcrete or gunite, a chemical resistant, lightweight material of potassium sillicate or silica type material with chemically inert filler material; calcium aluminate cement, sand, gravel and water all mixed to form a concrete like composition; a thermalsetting resin expoy reinforced with hardened materials such as glass, lime, aluminum, or boroslicate melt; diatomacious clay; or high alumina type fire brick, and the like, it being specifically understood that the scope of this invention is not limited to the specifically recited materials herein referred to from which inner liner 12 is capable of being fabricated, but rather, the scope of the invention extends to any such materials commonly known and usable within the prior art for such purposes. As illustrated in FIG. 2, there is depicted the utilization of gunite for inner liner 12.

In keeping with the invention, and as illustrated in FIG. 2, there is embedded within inner liner 12 electrically conductive wiring 13, structurally anchored by electrically non-conducting anchors 14 to outer structural support member 11.

It should be noted that it is within the scope of this invention to utilize an alarm system capable of detecting the degree of erosion of inner liner 12 of chimney stack 10 so as to determine when reconditioning of inner liner 12 is required prior to there occurring such a degree of erosion of inner liner 12 such that outer structural support member 11 does not become damaged.

In conjunction therewith, a variety of means are well known within the prior art that utilize various scientific principals which are capable of detecting conductive changes as related to electrically conductive wire 13, said changes being directly related to a change in the thickness of inner liner 12 as illustrated in FIG. 2.

More particularly, it is well known within the prior art to utilize bridge circuits (be they termed a Maxwell Bridge arrangement, Wien Bridge arrangement, Wheatstone Bridge arrangement or Impedence Bridge arrangement, or the like) for monitoring and otherwise detecting an impedence variation in one arm of said bridge arrangement, and in this manner, be able to detect and otherwise measure various forms and/or degrees of change in the physical properties related to that which is being monitored.

Additionally, strain gauges and thermocouple concepts are well known within the prior art and are capable of measuring variations in electrical conductivity and are also capable of being utilized in electrical bridge arrangements for detecting variations related to the monitoring of specific characteristics.

It is within the concepts referred to above that the present invention utilizes electrically conductive wire 13, or its equivalent, embedded within inner liner 12 as set foth in FIG. 2 that there is achieved the detection of a change in the thickness of inner liner 12 as inner liner 12 is eroded through the erosion process that goes on within chimney stack 10 as hot gases pass through chimney stack 10 in accordance with its operation.

Figure 5:
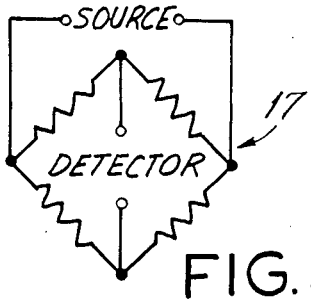
FIG. 5 is an electrical schematic of an electrical circuit well known in the prior art and more commonly known as the "Maxwell Bridge".

In accordance with the invention, reference is herein made to FIG. 5 which depicts Maxwell Bridge circuit 17, an electrical circuit well known within the prior art, which is capable of comparing and thus detecting a variation in the impedence characteristics across one arm of said bridge. In the preferred embodiment of this invention, the arm of said bridge circuit that is being monitored is that reflective of electrically conductive wire 13, as set forth in FIG. 2. In keeping with the invention, the impedence characteristics of electrically conductive wire 13 is subject to variation as a direct result of the erosion of inner liner 12 in which electrically conductive wire 13 is embedded, that variation in conductivity being thus monitored by Maxwell Bridge circuit 17 thus providing a means for determining the degree of erosion of inner liner 12. By selectively balancing Maxwell Bridge circuit 17 and by predetermining a degree of imbalance by which an output threshold signal triggers an alarm system, be it a visual alarm such as a light or an audible alarm such as a bell or some other indicator means, there is achieved a means of detecting a predetermined level of erosion of inner liner 12 that is to be considered a sufficient degree of erosion requiring the repair thereof, same being in accordance with this invention.

Additionally, it is also within the scope of this invention to continuously monitor the imbalance of a particular bridge circuit as referred to above in accordance with this invention, correlating same to the actual mechanical reduction of the thickness of inner liner 12 at the particular location of monitoring such that there is a constant read out of the remaining thickness of inner liner 12 at such a particular location.

It is in the context of the above that there is achieved the ability to monitor the erosion of inner liner 12 without the necessity of shutting down the operation of chimney stack 10 and thus enable monitoring of the structural condition of chimney stack 10 such that chimney stack 10 need only be shut down when repair of inner liner 12 is in fact actually needed.

In this fashion, in accordance with the invention, expensive delays as related to the shutting down of chimney stack 10 are avoided as well as there is avoided the incurring of structural damage to outer structural support member 11.

It should also be noted that although FIG. 5 illustrates the utilization of a Maxwell Bridge circuit 17 as the means to monitor the electrical conductivity of electrically conductive wire 13, nothing herein should be construed to so limit the scope of this invention to only the Maxwell Bridge circuit, but on the contrary, any circuitry capable of detecting variations in the conductivity of electrically conductive wire 13 can be utilized.

It should be kept in mind that one aspect of the present invention is to provide a means to monitor the degree of erosion of inner liner 12 throughout the entire structure of a chimney stack without necessitating the costly procedure of shutting down the operation of the chimney stack so as to do a manual inspection of the inner liner of said chimney stack.

In keeping with the above, it is within the scope of the invention to utilize more than one closed electrical circuit represented by electrically conductive wire 13 and more than one bridge circuit 17 in association therewith. More particularly, it is within the scope of the invention to have more than one bridge circuit 17 electrically coupled to more than one closed electrical circuit comprising electrically conductive wire 13, each such arrangement being related to the monitoring of different portions of inner liner 12 of chimney stack 10.

In further keeping with the invention, as inner liner 12 erodes due to the corrosive effect of the flue gases coming into contact with inner liner 12, the conductivity of the closed electrical circuit coupled across bridge circuit 17 represented by electrically conductive wire 13 will also change in a degree corresponding to the degree of erosion of inner liner 12. As the erosion of inner liner 12 occurs, the degree of erosion is thus capable of being monitored by observing the change in the conductivity of the closed electrical circuit created by electrically conductive wire 13 which is coupled across bridge circuit 17. By predetermining the degree of imbalance across bridge circuit 17 that will trigger a warning signal, an effective means to monitor the erosion of inner liner 12 is achieved.

It should also be noted that by utilizing electrically conductive wire 13 embedded within inner liner 12 as set forth above, there is achieved the additional benefit of increasing the structural integrity of chimney stack 10 since electrically conductive wire 13 will act similarly to reinforcing steel members or the like as used in concrete construction.

Figure 3:
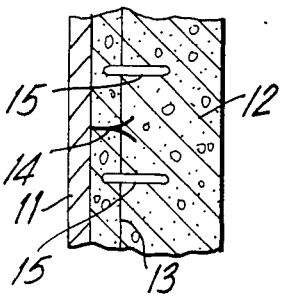
FIG. 3 is an enlarged partial vertical section of the chimney stack illustrated in FIG. 1 and taken along lines 3—3 illustrating an alternative embodiment of a design for the composition of the chimney stack structure at that location constructed in accordance with the invention.

Reference is now made to FIG. 3 wherein there is illustrated an alternative embodiment of the invention wherein in place of utilizing electrically conductive wire 13 whose impedence is monitored as hereinabove set forth and this provides a means for determining a change in the thickness of inner liner 12, there is utilized probe members 15. In conjunction therewith, probe members 15 are utilized in a manner well known within the prior art as sensor means in conjunction with thermocouple circuitry which as is well known within the prior art, same being capable of monitoring changes in the thickness of inner liner 12 as depicted in FIG. 3. By detecting the variations in the thermal energy imparted to probe members 15 as compared to the temperature levels that should be detected by probe members 15 prior to inner liner 12 experiencing any erosion there is thus established as is well known within the prior art, a criteria for calculating the actual changes in thickness of inner liner 12 without the necessity of shutting down the operation of chimney stack 10 to measure same, the above being in accordance with the present invention.

Figure 4:
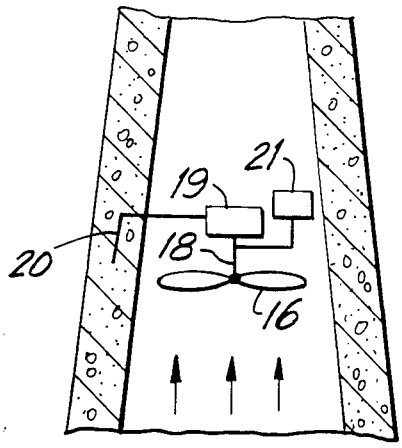
FIG. 4 is an enlarged partial vertical section of the chimney stack illustrated in FIG. 1 and taken along lines 4—4 illustrating the positioning of a pair of turbine blades within the stream of gas flow of the chimney stack.

Reference is now herein made to FIG. 4 wherein there is illustrated the positioning of a pair of turbine blades 16 within the stream of gas flow of chimney stack 10. In keeping with the invention, flue gases passing through chimney stack 10 travel at various velocities, it not being uncommon for these velocities to reach 50 feet per second. By positioning a pair of turbine blades 16 within the stream of gas flow within chimney stack 10 and coupling same through mechanical means well known within the prior art to electrical generators, the mechanical rotational movement of turbine blades 16 can be converted into electrical energy capable of utilization either outside of chimney stack 10 or in accordance with the operation of chimney stack 10.

As illustrated in FIG. 4, turbine blades 16, of any well known design and construction available in the prior art are mounted about a rotational axis 18 which in turn is mechanically coupled to drive an electrical generator 19 of any design or construction well known in the prior art, the electrical output from generator 19 being illustrated by output 20.

Figure 6:
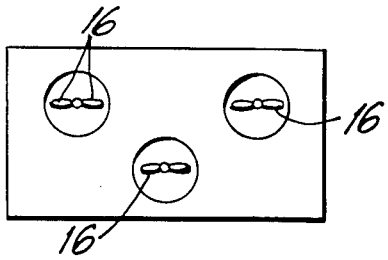
FIG. 6 is an alternative embodiment of the invention utilizing three sets of turbine blades symmetrically positioned within the chimney stack.

As further illustrated in FIG. 4, and in keeping with the invention, turbine blades 16 can be located anywhere within the path of the flue gases of chimney stack 10. Further, it is within the scope of this invention to utilize a design of turbine blades that is in excess of two depending on design criteria, nothing herein to be interpreted to so limit the scope of the invention to a two blade turbine arrangement. Additionally, it is within the scope of the invention to utilize a design wherein more than one pair of turbine blades are utilized, there being illustrated as exemplary of the above in FIG. 6, the utilization of three separate turbine blade configurations, same being in accordance with the invention.

As an integral part of the above and as illustrative of the invention, the utilization of turbine blades 16 as hereinabove set forth causes the generation of air turbulence in the gas flow downstream from said location within chimney stack 10. As a result, means are provided for minimizing the build up of particulate material on the surface of inner liner 12, thus reducing the degree of erosion and/or corrosion to which inner liner 12 is exposed. In this manner, a self-cleaning feature is achieved in accordance with the invention as to the overall design of chimney stack 10 aside from obtaining the efficiencies of obtaining a source of electrical energy. By combining this self-cleaning feature which in effect increases the life of inner liner 12 with the self-monitoring feature of this invention whereby the degree of erosion of inner liner 12 is monitored without the need to shut down the operation of chimney stack 10 for physical inspection, there is achieved some of the advantages and efficiencies which are illustrative of the invention.

It should additionally be noted that the utilization of turbine blades 16 and the resulting self-cleaning feature occurring therefrom as well as the ability to utilize turbine blades 16 to additionally generate electricity as herein set forth, is not solely related to a chimney stack having an erodable inner liner, but said concepts, in accordance with the invention, are applicable to other stack designs well known in the prior art.

In addition, there is also the added feature of the present invention to self-induce various degrees of turbulence downstream from the location of the turbine blades 16 by the selective utilization of motor 21 which is capable of utilizing an independent source of energy to cause turbine blades 16 to rotate at a desired degree of rotation in the event the flue gases do not have sufficient energy to cause such rotation. In this manner, there is achieved the ability to selectively cause downstream from turbine blades 16 air turbulance of a desired degree and for a particular period merely by actuating motor 21, thereby causing selected air turbulence for the removal of particulate material from inner liner 12.

The preceding descriptions and accompanying drawings relate primarily to a specific embodiment of the invention, and the invention in its broader aspects should not be so limited to one specific embodiment as herein shown and described but departures may be made therefrom within the scope of the accompanying claims without departing from the principles of the invention and without sacrificing its chief advantages.

I claim:

1. A new and improved chimney stack capable of conveying hot gases generated in conjunction with industrial application to a height within the atmosphere sufficient to meet current pollution standards that is capable of being monitored to detect the degree of erosion occurring to it prior to sustaining structural damage, said chimney stack comprising:

(a) an outer structural support member capable of providing a stable structure capable of conveying hot gases into the elevated portions of the atmosphere;

(b) an inner liner subject to erosion by said hot gases structurally affixed to said outer structural support member thereby insulating said outer structural support member from contact with said hot gases passing through said chimney stack;

(c) electrical wiring embedded within said inner liner and arranged as part of an electrical circuit whose conductivity is monitored so as to detect the erosion of said inner liner;

(d) monitoring circuitry incorporating said electrical wiring capable of detecting changes in the electrical conductivity of said circuitry thereby detecting the degree of erosion of said inner liner;

2. A new and improved chimney stack capable of conveying hot gases generated in conjunction with industrial application to a height within the atmosphere sufficient to meet current pollution standards that is capable of being monitored to detect the degree of erosion occurring to it prior to sustaining structural damage as defined in claim 1 additionally comprising:

(a) turbine blades structurally affixed to said chimney stack and positioned within the stream of gas flow within said chimney stack, said turbine blades capable of being mechanically rotated about their axis as a result of the stream of gas flow passing past said turbine blades within said chimney stack;

(b) electrical generating means mechanically driven by said turbine blades and capable of converting the rotational movement of said turbine blades into electrical energy.

3. A new and improved chimney stack capable of conveying hot gases generated in conjunction with industrial application to a height within the atmosphere sufficient to meet current pollution standards that is capable of being monitored to detect the degree of erosion occurring to it prior to sustaining structural damage as defined in claim 2 additionally comprising a source of mechanical and/or electrical energy capable of causing said turbine blades to selectively rotate independent of the stream of gas flow within said chimney stack so as to selectively cause air turbulence within said chimney stack downstream from the location of said turbine blades thus providing a means to selectively reduce the build up of particulate material upon said inner liner.

4. A new and improved chimney stack capable of conveying hot gases generated in conjunction with industrial application to a height within the atmosphere sufficient to meet current pollution standards that is capable of being monitored to detect the degree of erosion occurring to it prior to sustaining structural damage as defined in claim 3 wherein more than one set of turbine blades are utilized.

5. A new and improved chimney stack capable of conveying hot gases generated in conjunction with industrial application to a height within the atmosphere sufficient to meet current pollution standards that is capable of being monitored to detect the degree of erosion occurring to it prior to sustaining structural damage, said chimney stack comprising:

(a) an outer structural support member capable of providing a stable structure capable of conveying hot gases into the elevated portions of the atmosphere;

(b) an inner liner subject to erosion by said hot gases structurally affixed to said outer structural support member thereby insulating said outer structural support member from contact with said hot gases passing through said chimney stack;

(c) thermocouple probe members embedded within said inner liner capable of detecting the temperature levels of said inner liner at each of said thermocouple probe members location by comparing said temperature readings to temperature readings of said same thermocouple probe members prior to there being any erosions of said inner liner, there thus being achieved a means to determine the degree of erosion occurring to said inner liner without the necessity of shutting down the operation of said chimney stack.

* * * * *